US008584960B2

(12) United States Patent
Makida et al.

(10) Patent No.: US 8,584,960 B2
(45) Date of Patent: Nov. 19, 2013

(54) PAPER

(75) Inventors: Seigo Makida, Kanagawa (JP); Shoji Yamaguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 154 days.

(21) Appl. No.: 13/088,469

(22) Filed: Apr. 18, 2011

(65) Prior Publication Data

US 2012/0138692 A1 Jun. 7, 2012

(30) Foreign Application Priority Data

Dec. 2, 2010 (JP) ..... 2010-269373

(51) Int. Cl.
*G06K 19/06* (2006.01)

(52) U.S. Cl.
USPC ..... 235/493; 235/375

(58) Field of Classification Search
USPC ..... 235/493, 449, 487, 375
See application file for complete search history.

(56) References Cited

U.S. PATENT DOCUMENTS 3,256,584 A 6/1966 Parkhachev
5,756,220 A * 5/1998 Hoshino et al. ..... 428/537.5
5,944,927 A * 8/1999 Seifert ..... 156/153
7,896,251 B2 3/2011 Yamaguchi et al.
2006/0209147 A1 9/2006 Takahashi et al.
2006/0232829 A1 10/2006 Koda et al.
2007/0040037 A1 2/2007 Koda et al.
2007/0099130 A1* 5/2007 Takahashi et al. ..... 430/435
2007/0145967 A1 6/2007 Yamaguchi et al.
2007/0178260 A1* 8/2007 Levy et al. ..... 428/34.2
2007/0243403 A1 10/2007 Matsuda et al.
2008/0013212 A1 1/2008 Fuse et al.
2008/0018674 A1 1/2008 Matsuda et al.
2008/0226849 A1 9/2008 Matsuda et al.
2009/0017334 A1 1/2009 Kurihara et al.
2010/0295291 A1* 11/2010 Rancien et al. ..... 283/113

FOREIGN PATENT DOCUMENTS

JP 2006-268538 10/2006
WO 97/24734 7/1997

OTHER PUBLICATIONS

Extended European Search Report in 11165898.5 dated Jun. 4, 2012.

* cited by examiner

*Primary Examiner* — Edwyn Labaze
(74) *Attorney, Agent, or Firm* — Fildes & Outland, P.C.

(57) ABSTRACT

The invention provides a paper having a paper body which contains pulp fiber and a magnetic material having a large Barkhausen effect, and an image that is formed on at least one surface of the paper body and is simulative of the magnetic material contained in the paper body.

5 Claims, 3 Drawing Sheets

PAPER

CROSS-REFERENCE TO RELATED APPLICATIONS

This application is based on and claims priority under 35 USC 119 from Japanese Patent Application No. 2010-269373 filed on Dec. 2, 2010.

BACKGROUND

1. Technical Field

The present invention relates to a paper.

2. Related Art

There has been disclosed a medium provided with magnetic elements that generate a signal when a magnetic field is applied, characterized in that plural pseudo-elements which have the same size and shape as those of the magnetic elements but do not generate a signal even when the magnetic field is applied, are provided to be present in mixture with the magnetic elements.

SUMMARY

According to an aspect of the present invention, there is provided a paper including:

a paper body which contains a pulp fiber, and a magnetic material having a large Barkhausen effect; and an image which is formed on at least one surface of the paper body, and is simulative of the magnetic material contained in the paper body.

BRIEF DESCRIPTION OF THE DRAWINGS

Exemplary embodiments of the present invention will be described in detail, based on the following figures, wherein.

DETAILED DESCRIPTION

[Paper]

Hereinafter, an exemplary embodiment of the present invention will be described in detail with reference to the accompanying drawings. In addition, for members having a substantially identical function, a same symbol will be assigned through the drawings, and overlapping explanations will not be repeated in some cases.

Figure 1:
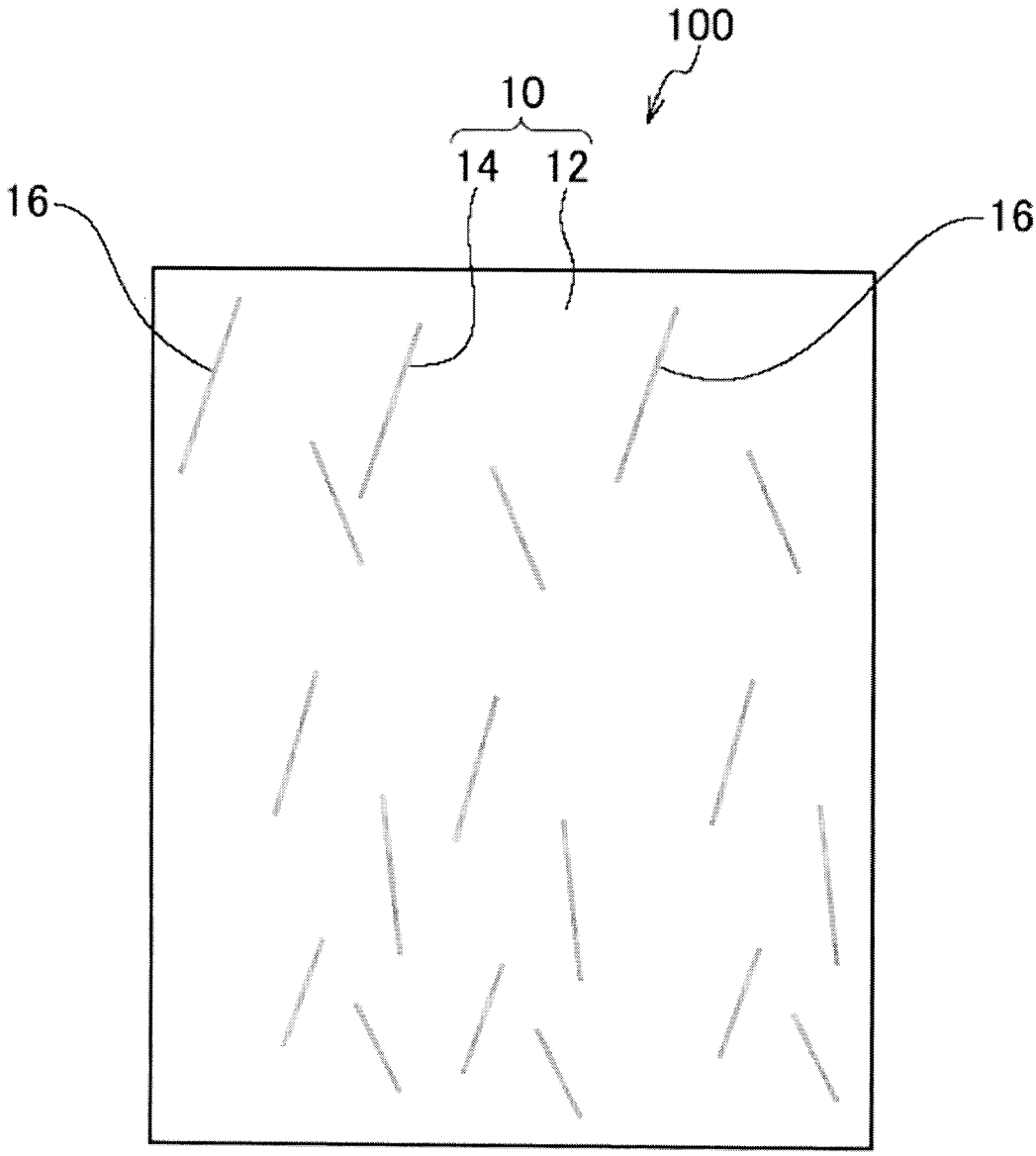
FIG. 1 is a plan view illustrating an example of a paper according to an exemplary embodiment of the present invention.
Figure 2:
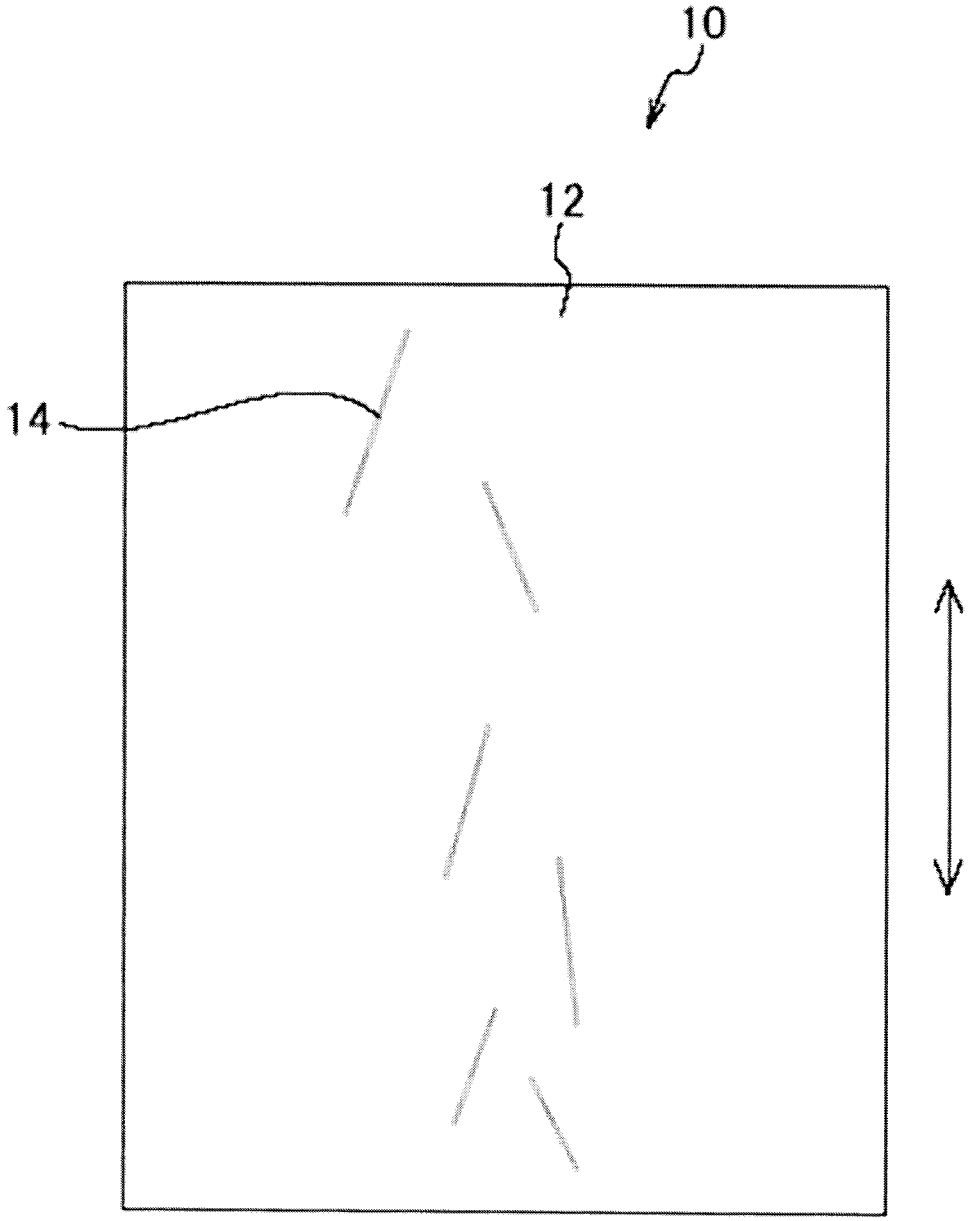
FIG. 2 is a plan view showing the paper body of the paper shown in FIG. 1.
Figure 3:
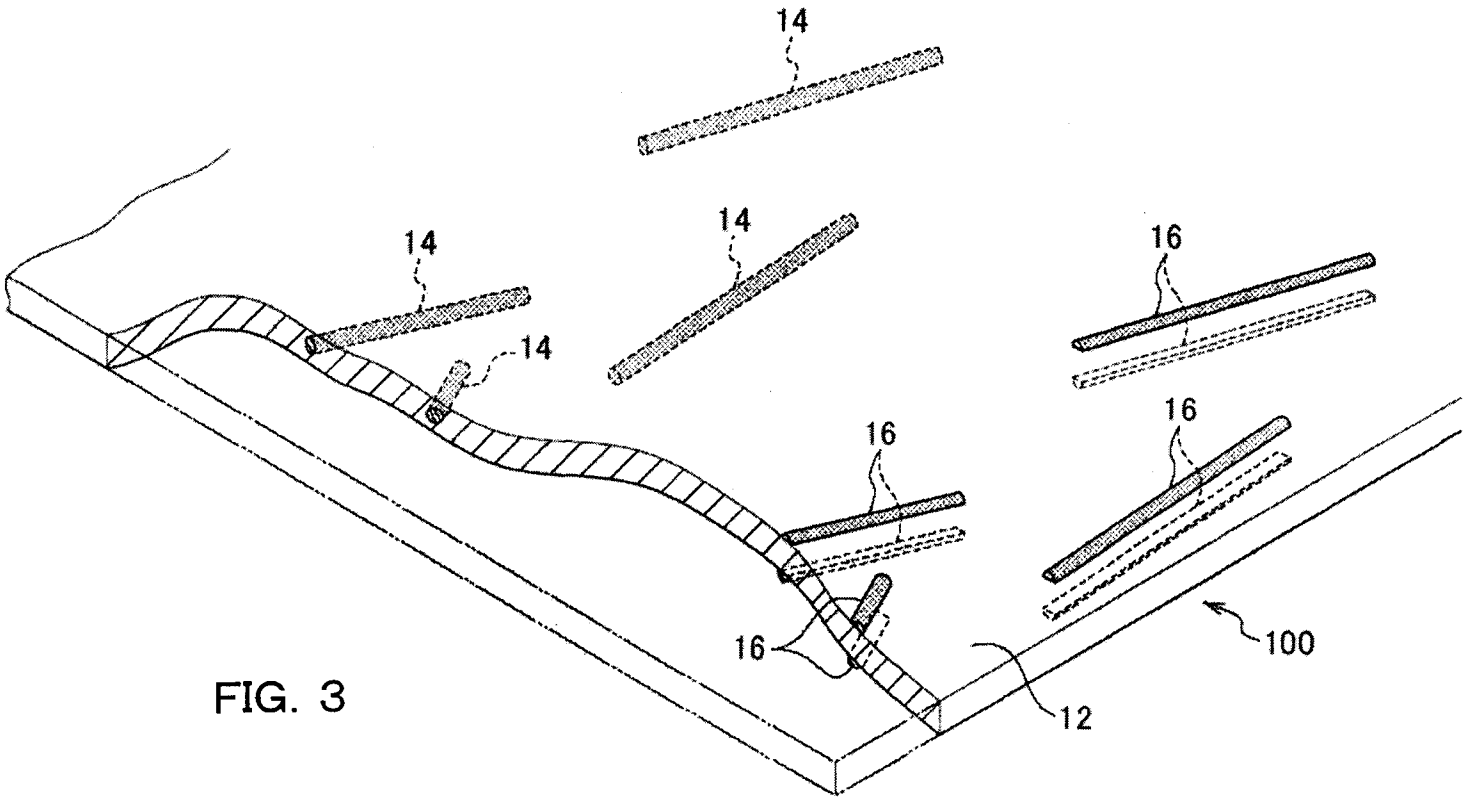
FIG. 3 is a perspective view showing part of the paper shown in FIG. 1 under magnification.

FIG. 1 is a plan view showing an example of the paper related to the exemplary embodiment. FIG. 2 is a plan view showing the paper body used in the paper shown in FIG. 1. FIG. 3 is a perspective view (partial, shown as a cross-sectional view) of part of the paper shown in FIG. 1 under magnification.

As shown in FIG. 1 to FIG. 3, the paper 100 related to the exemplary embodiment has a paper body 10 which contains pulp fiber 12 and a magnetic material 14 having a large Barkhausen effect, and an image 16 which is formed on at least one surface of the paper body 10 and is simulative of the magnetic material 14 contained in the paper body 10. That is, the paper 100 related to the exemplary embodiment has a pseudo-image 16 which is simulative of the magnetic material 14 that is in a state of being embedded in a papermaking manner, formed on the surface of the paper body 10 on which the magnetic material 14 having a large Barkhausen effect has been embedded in a papermaking manner.

First, the paper body 10 will be explained.

As described above, in the paper body 10, the magnetic material 14 having a large Barkhausen effect is embedded in a papermaking manner, and as shown in FIG. 3, for example, the magnetic material 14 is present in the interior of the paper body 10.

The magnetic material 14 is, for example, a fibrous magnetic fiber. Furthermore, for example, six magnetic materials 14 are embedded in a papermaking manner in a linear shape per sheet of the paper body 10. The magnetic materials 14 embedded in a papermaking manner in the paper body 10 are aligned along the papermaking direction (direction of the arrow in FIG. 2), and the magnetic materials are localized in the central area with respect to the direction perpendicular to the papermaking direction, in the plane of the paper body 10. In other words, according to the exemplary embodiment, the magnetic materials 14 are present in a band-like area having a certain width, in the plane of the paper body 10. The band-like area is positioned in the central area of the direction perpendicular to a papermaking direction, in the plane of the paper body 10, and is extended in the papermaking direction. However, the position of the band-like area in which the magnetic materials 14 are present, is not limited thereto.

According to the exemplary embodiment, the magnetic materials 14 are embedded in a papermaking manner in a linear shape, but without being limited to this, the magnetic materials 14 may also be embedded in a papermaking manner in the paper body 10 in a curved state. Also, there are no particular limitations on the number of the magnetic materials 14 embedded in a papermaking manner per sheet of the paper body 10, and the direction and position of the magnetic materials 14 embedded in a papermaking manner in the paper body 10, and the number, direction and position are selected in accordance with the production method, size, applications, and the like of the paper body 10. Specifically, for example, the magnetic materials 14 are not localized in the central area of the paper body 10, and the magnetic materials 14 may be present over the entire area of the paper body.

Next, the pseudo-image 16 will be described.

The pseudo-image 16 is an image which is simulative of the magnetic material 14 that is embedded in a papermaking manner in the paper body 10, as described above.

The magnetic material 14 that is present in the interior of the paper body 10 is observed in such a manner that when the surface of the paper body 10 is observed from the outside of the paper body 10, the magnetic material 14 shows through the pulp fiber 12. Specifically, for example, in the case where the pulp fiber 12 is white in color, and the magnetic material 14 is a black magnetic fiber, when the surface of the paper body 10 is observed, the magnetic material 14 is visible through the white pulp fiber 12. Therefore, the magnetic material 14 is seen as a linear form (fibrous form) having a color that is not darker (for example, gray) than the actual color (black). The image of that gray linear form is then used as the pseudo-image 16.

As shown in FIG. 1, according to the exemplary embodiment, the pseudo-image 16 is formed within the surface of the paper body 10, over the entire area where the magnetic material 14 is not formed. However, the position at which the pseudo-image 16 is formed is appropriately selected in accordance with the use or the like of the paper 100, and is not limited to the above-described form. Specifically, for example, the pseudo-image 16 may be formed over the entire surface of the paper 100, or the magnetic material 14 and the pseudo-image 16 may be formed to overlap each other. Alternatively, the pseudo-image 16 may also be formed in an area that is outside the area where it is desirable not to form the pseudo-image 16. As such, the position and number of the pseudo-images 16 formed on the paper 100 are selected in accordance with the use or the like of the paper 100.

According to the exemplary embodiment, as shown in FIG. 3, a pseudo-image 16 is formed on both surfaces of the paper body 10, and the pseudo-images 16 formed on both the surfaces constitute an overlapping image when the images are projected in the thickness direction of the paper body 10. Here, the term "thickness direction of the paper body 10" means a direction perpendicular to the paper surface of the paper body 10.

Hereinafter, the two images that overlap each other when the images are projected in the thickness direction of the paper body 10, may be referred to as a "projected overlapping image," and when at least part of the pseudo-image 16 formed on one surface of the paper body 10 (for example, the pseudo-image 16 shown in FIG. 1; hereinafter, may be referred to as "first image") is overlapping with at least part of the pseudo-image 16 formed on the other surface of the paper body 10 (hereinafter, may be referred to as "second image"), the pseudo-image 16 referred to as the "projected overlapping image."

According to the exemplary embodiment, in addition to overlapping, the first image and the second image constitute a matching image when the images are projected in the thickness direction of the paper body 10 (hereinafter, may be referred to as a "projected matching image"). Specifically, the first image and the second image are directed in the same direction, and the first image and the second image are at a position in which the two edges of the first image and the two edges of the second image coincide when the images are projected in the thickness direction of the paper body 10.

According to the exemplary embodiment, though not depicted, an image which is simulative of the state in which the magnetic material 14 shows through when the paper 100 is visually inspected by reflected light that has been reflected from the surface of the paper 100 (for example, the paper 100 is placed on a table and observed) (hereinafter, may be referred to as a "reflected light pseudo-image"), as well as an image which is simulative of the state in which the magnetic material 14 shows through when the paper 100 is visually inspected by light transmitted through the paper 100 (for example, the paper 100 is observed by holding the paper up to the fluorescent light or sunlight) (hereinafter, may be referred to as a "transmitted light pseudo-image") are both formed as a pseudo-image 16.

According to the exemplary embodiment, when the magnetic material 14 embedded in a papermaking manner in the paper body 10 is visually inspected by light transmitted through the paper, the color appears darker as compared with the case in which the magnetic material 14 is visually inspected by reflected light. Thus, thought not depicted, the transmitted light pseudo-image constitutes an image of dark gray color, as compared with the reflected light pseudo-image.

Hereinafter, the method for producing the paper 100 will be described.

First, a paper body 10 is produced. An example of the method for producing the paper body 10 may be a method of obtaining a paper body 10 having a magnetic material 14 embedded in a papermaking manner, by adding a magnetic material dispersion liquid in which the magnetic material 14 is dispersed in a water-based medium, to a pulp slurry in which pulp fiber 12 is dispersed, and then papermaking the pulp fiber 12 including the magnetic material 14. Furthermore, those other materials that will be described below may be added, if necessary, to the magnetic material dispersion liquid, may be added to the pulp slurry, or may be added after the pulp fiber 12 including the magnetic material 14 has been papermade.

Subsequently, a pseudo-image 16 is formed on the paper body 10 thus obtained. There are no particular limitations on the method of forming the pseudo-image 16, and the pseudo-image 16 may be formed as a toner image by an electrophotographic system, the pseudo-image 16 may be formed as an ink image by an inkjet system, or the pseudo-image 16 may be formed by any other method.

An example of the method of forming the pseudo-image 16 on the surface of the paper body 10 may be a method of forming a pseudo-image 16 by observing the surface of the paper body 10 in each case to obtain an image of the magnetic material 14 in the paper body 10, and printing the same image as the obtained image on the surface of the paper body 10, but is not limited to this. For example, in the case where the image of the magnetic material 14 that is in the state of being embedded in a papermaking manner in the paper body 10 has been obtained in advance, it is not necessarily needed to observe the surface of the paper body 10 on a case-by-case basis, and an image that has been previously obtained may be used to form the pseudo-image 16 on the surface of the paper body 10.

Furthermore, in the case of obtaining an image of the magnetic material 14 in the paper body 10 through observation, an observation is carried out in accordance with the type of the pseudo-image 16 to be formed. That is, for example, in the case of using a reflected light pseudo-image as the pseudo-image 16, reflected light is used in a state in which the paper body 10 does not transmit light, and an observation of the surface of the pseudo-image 10 is carried out. Furthermore, for example, in the case of using a transmitted light pseudo-image as the pseudo-image 16, light is transmitted through the paper body 10, and an observation of the paper body 10 is carried out by the light transmitted through the paper.

The paper 100 of the exemplary embodiment explained above has a pseudo-image 16 formed on the surface of the paper body 10 as described above, and therefore, the position of the magnetic material 14 contained in the paper body 10 is not easily identified visually.

Specifically, as shown in FIG. 2, in the paper body 10 in which the magnetic material 14 is embedded in a papermaking manner, even though the magnetic material 14 may be present in the interior of the paper body 10, the magnetic material 14 may be observed through the pulp fiber 12 at the surface of the paper body 10. Accordingly, when there is no pseudo-image 16 formed on the surface, the positions of all of the magnetic materials 14 are easily identified only by visually observing the surface of the paper body 10.

On the other hand, in regard to the paper 100 of the exemplary embodiment, even if the surface is visually observed, it is difficult to distinguish between the pseudo-image formed on the paper body 10 and the magnetic material 14 that is embedded in a papermaking manner in the paper body 10. Therefore, it is thought that the position where the magnetic material 14 is actually present is not easily identified visually, as compared with the case in which there is no pseudo-image 16 formed.

As such, since the position of the magnetic material 14 is not easily identified in the paper 100 according to the exemplary embodiment, for example, when the paper 100 is used as a recording medium for recording confidential information and the like that should not be brought up to the outside of a certain space, the leak of the confidential information and the like is suppressed as compared with the case in which other recording media are used.

Specifically, for example, as the magnetic material 14 passes through the boundary between the space and the surroundings, if there is provided a detecting means for detection purposes, when important documents having confidential information and the like recorded on the paper body 10 are taken out from the space to the outside, the taking out is detected since the paper body 10 contains the magnetic material 14. Furthermore, it is believed that, for example, in the case where the detection of the taking out of important documents is notified, or in the case where an alarm is triggered by the detection of the taking out of important documents, taking out of important documents to the outside will be hesitated so that the leak of confidential information and the like may be suppressed.

However, when the position of the magnetic material 14 is readily identifiable by visible inspection, since it is easy to cut out only the areas where the magnetic material 14 is not present from the important documents, it is thought that parts of the important documents may be taken out to the outside without being detected, and thus confidential information and the like may be more easily leaked out.

On the other hand, when the paper 100 of the exemplary embodiment is used as a recording medium, since the position of the magnetic material 14 is not easily identified visually, there is no chance that, for example, cutting out of only the areas where the magnetic material 14 is not present from the paper 100 is easily achievable. Specifically, for example, in order to cut out for sure only the areas where the magnetic material 14 is not present, it is necessary to cut out only the areas in which there is no pseudo-image 16 formed, or to cut out the areas where the pseudo-image 16 is formed only after the pseudo-image 16 is distinguished from the magnetic material 14. For that reason, efforts to cut out the areas that do not include the pseudo-image 16 or a time to identify the pseudo-image 16 will be required, and therefore, it is believed to be difficult to cut out only the areas where the magnetic material 14 is not present. Accordingly, it is contemplated that when the paper 100 of the exemplary embodiment is used, the leak of confidential information and the like is suppressed as compared to the case of using other recording media.

Furthermore, according to the exemplary embodiment, a pseudo-image 16 is formed on the surface of the paper body 10 as described above, and therefore, the position of the magnetic material 14 is not easily identified. Accordingly, for example, there is no need for high costs, and it is easier to control the position or shape of the pseudo-image 16, as compared with the case in which a pseudo-material that is similar to the magnetic material 14 in terms of color, shape and size, is embedded in a papermaking manner together with the magnetic material 14. Furthermore, since there is an upper limit in the total amount of the magnetic material 14 and the pseudo-material that may be included in a papermaking manner in the paper body 10, the amount of the magnetic material 14 included in a papermaking manner is reduced as the amount of the pseudo-material used increases. However, in the exemplary embodiment, even if the pseudo-image 16 is formed to a large extent, the amount of the magnetic material 14 that is included in a papermaking manner is not reduced. Therefore, since the amount of the magnetic material 14 that is included in a papermaking manner is reduced as compared to the case of using a pseudo-material, it is contemplated that the position of the magnetic material 14 is not easily identified visually, while a decrease in the detection performance for the magnetic material 14 is suppressed.

In the paper 100 of the exemplary embodiment, since the pseudo-image 16 is formed on both sides of the paper body 10, even if the paper 100 is observed from any side, the magnetic material 14 that is embedded in a papermaking manner in the paper body 10 and the pseudo-image 16 are both visually recognized, and the position of the magnetic material 14 is not easily identified. Therefore, as compared with the case in which the pseudo-image 16 is formed only on one side of the paper body 10, it takes time to cut out only the areas in which the magnetic material 14 is not present, and it is thought that taking out of the paper will not be facilitated.

In the paper 100 shown in FIG. 1 and FIG. 3, as described above, the pseudo-image 16 is formed on both surfaces of the paper body 10, but without being limited to this, an embodiment having the pseudo-image 16 formed on only one surface of the paper body 10 may also be used.

Furthermore, in the paper 100 of the exemplary embodiment, as described above, the pseudo-images 16 formed on the two surfaces constitute a projected overlapping image, it is difficult to distinguish the projected overlapping image from the state in which one piece of the magnetic material 14 that has been actually embedded in a papermaking manner shows through from both of the surfaces in the paper body 10. Therefore, although both of the surfaces of the paper 100 are observed and compared, the position of the magnetic material 14 is not easily identified visually. Furthermore, as compared with the case in which the pseudo-image 16 formed on both surfaces is not a projected overlapping image, much more efforts are needed to cut out only the areas in which the magnetic material 14 is not present, and it is thought that taking out of the paper will not be facilitated.

Furthermore, in the paper 100 of the exemplary embodiment, since the pseudo-image 16 formed on both surfaces is a projected coinciding image, it is difficult to distinguish the projected coinciding image from the state in which one piece of the magnetic material 14 that has been actually embedded in a papermaking manner shows through from both of the surfaces in the paper body 10.

In the paper 100 of the exemplary embodiment, the pseudo-images 16 formed on the two surfaces constitute a projected coinciding image, but the pseudo-image 16 is not limited to this. For example, the pseudo-image 16 may be a projected overlapping image in which parts of the pseudo-images 16 formed on the two surfaces overlap. More specifically, for example, the pseudo-image 16 may be in the form in which the first image and the second image intersect with each other, or the pseudo-image 16 may be in the form in which the first image and the second image are directed toward the same direction, with part thereof being overlapped. Furthermore, for example, the pseudo-image 16 may be in the form in which when the paper is projected in the thickness direction of the paper body 10, the pseudo-images 16 formed on the two surfaces do not overlap, or may be in the form in which, for example, the pseudo-images 16 formed on the two surfaces are present nearby in the shapes that are in agreement with each other, and thereby it is difficult to distinguish the pseudo-images from one piece of the magnetic material 14.

In the paper 100 of the exemplary embodiment, as described above, since both the reflected light pseudo-image and the transmitted light pseudo-image are formed, it is contemplated that it is more difficult to identify the position of the magnetic material even by visual inspection by light transmitted through the paper as well as by visual inspection by reflected light.

As discussed above, for example, in the case where the pseudo-image 16 is a reflected light pseudo-image only, when the paper 100 is visually inspected by light transmitted through the paper, the magnetic material 14 in the paper body 10 appears darker than the reflected light pseudo-image as compared with the case in which the paper is visually inspected by reflected light, and therefore, it is thought that it is easier to distinguish between the magnetic material 14 and the pseudo-image 16. On the other hand, when a reflected light pseudo-image and a transmitted light pseudo-image are both formed on the paper 100, since there are present pseudo-images 16 that are not easily distinguished from the magnetic material 14 even by visual inspection by light transmitted through the paper as well as by visual inspection by reflected light, it is thought that it is more difficult to identify the position of the magnetic material.

In addition, as described above, a reflected light pseudo-image and a transmitted light pseudo-image are both formed in the exemplary embodiment, but the invention is not limited to this, and it is preferable that a pseudo-image 16 which conforms to any one or more methods among the methods for observing the surface of the paper 100 be formed on the paper body 10.

In the exemplary embodiment, all of the magnetic materials 14 are present in the interior of the paper body 10 (that is, central area in the thickness direction in the paper body 10), but the invention is not limited to this, and for example, an embodiment in which there are present magnetic materials 14 that are exposed at the surface of the paper body 10, is also acceptable.

Furthermore, according to the exemplary embodiment, as described above, a pseudo-image 16 may be formed on the surface of the paper body 10, or an image other than the pseudo-image 16 may be formed in addition to the pseudo-image 16. In the case of a paper in which an image other than the pseudo-image is formed on the paper body, the image other than the pseudo-image may be formed after only the pseudo-image is formed on the paper body, or an image obtained by integrating the pseudo-image and the image other than the pseudo-image may be formed on the paper body.

That is, the exemplary embodiment may be an embodiment in which a paper 100 having only a pseudo-image 16 formed on the surface of the paper body 10 is distributed, and the user forms an image other than the pseudo-image 16 on the paper 100, or an embodiment in which the user forms a pseudo-image 16 and an image other than the pseudo-image 16 on the paper body 10.

Hereinafter, the various constituent members (material) will be described in detail. Symbols will not be indicated in the descriptions.

—Pulp Fiber—

The pulp fiber may be, for example, a chemical pulp, and specific examples thereof include wood pulps such as hardwood bleached kraft pulp, hardwood unbleached kraft pulp, softwood bleached kraft pulp, softwood unbleached kraft pulp, hardwood bleached sulfite pulp, hardwood unbleached sulfite pulp, softwood bleached sulfite pulp, and softwood unbleached sulfite pulp; and pulps produced by chemically treating fiber raw materials such as cotton, hemp and bast.

Furthermore, a groundwood pulp produced by mechanically pulping wood or chips, a chemimechanical pulp produced by soaking wood or chips with a chemical liquid and then mechanically pulping the wood or chips, a thermomechanical pulp produced by digesting chips until they become soft and then pulping the chips with a refiner, and the like may also be used as the pulp fiber.

Various fibers such as cotton pulp fiber, hemp pulp fiber, kenaf pulp fiber, bagasse pulp fiber, viscose rayon fiber, recycled cellulose fibers, cuprammonium rayon fibers, cellulose acetate fibers, polyvinyl chloride-based fibers, polyacrylonitrile-based fibers, polyvinyl alcohol-based fibers, polyvinylidene chloride-based fibers, polyolefin-based fibers, polyurethane-based fibers, polyvinyl chloride, polyvinyl alcohol copolymers, fluorocarbon-based fibers, glass fibers, carbon fibers, alumina fibers, metal fibers, and silicon carbide fibers may also be used as the pulp fiber.

Furthermore, if necessary, fibers obtained by impregnating or thermally fusing pulp fiber with a synthetic resin such as polyethylene, polypropylene, polystyrene, polyvinyl chloride or polyester, may also be used.

These pulp fibers may be used in a virgin state only, or if necessary, high-quality and medium-quality recycled pulps may be incorporated. The amount of incorporation of the recycled pulp is determined in accordance with the use or purpose, but for example, in the case of incorporating recycled pulp, the recycled paper may be incorporated in an amount of 10% by weight or greater, or may be incorporated in an amount of 30% by weight or greater, based on the total amount of fiber.

Particularly, the pulp that is used in a virgin state may be a pulp which has been subjected to a bleaching treatment by a bleaching method of using chlorine dioxide without using chlorine gas (Elementally Chlorine Free; ECF), or a method of bleaching by mainly using ozone/hydrogen peroxide or the like without using a chlorine compound at all (Total Chlorine Free; TCF).

Furthermore, as the raw material of the recycled pulp, unprinted recovered papers such as white shavings (Jouhaku), high-grade white wood-containing shavings (Tokuhaku), white wood-containing shavings (Chuuhaku), and white cuttings (Hakushon), which are shavings, cuttings and sheets produced by bookbinders, printing factories and sheet cutting facilities; printed recovered wood-free papers such as wood-free paper that has been subjected to printing or copying, and wood-free coated paper; recovered papers printed with aqueous ink, oil ink, pencil and the like; newspaper recovered papers including printed wood-free paper, coated wood-free paper, wood-containing paper, and wood-containing coated paper; recovered papers such as wood-containing paper, coated wood-containing paper, and groundwood paper, may also be incorporated.

The recycled pulp may be a product obtained by treating recovered paper raw materials with at least one of an ozone bleaching treatment and a hydrogen peroxide bleaching treatment. Furthermore, the mixing ratio of the recycled pulp obtained by those bleaching treatments may be from 50% by weight to 100% by weight.

—Magnetic Material—

The magnetic material is not particularly limited in terms of the magnetic properties, composition, shape and the like, as long as the magnetic material is a magnetic material having characteristics that cause a large Barkhausen effect, and an example of the magnetic material may be a magnetic fiber, which is a fibrous magnetic material (in other words, linear or band-shaped).

Examples of the composition of the magnetic fiber include alloys (for example, Co-based, Fe-based and Ni-based alloys, mixtures thereof; specifically, for example, Co—B—Si, and Co—Fe—B—Si) containing magnetic elements (for example, Co, Fe and Ni), transition metals and glass-forming elements (for example, Si, B, C and P), and when the composition ratio of the constituent elements or the production method is appropriately selected, magnetic fibers having various magnetic characteristics may be used. In addition, the hue of amorphous alloys formed from the elements described above is not much affected by the proportions of the elements.

In regard to the shape and size of the magnetic fiber, for example, if the thickness of the paper body is from 80 μm to 120 μm, a magnetic fiber having a circular cross-section and an outer diameter (fiber diameter) of from 10 μm to 60 μm. The external shape of the magnetic fiber may be from 15 μm to 55 μm, and may also be from 25 μm to 45 μm. On the other hand, in regard to the length of the magnetic fiber (fiber length), for example, in the case of a fiber having an outer diameter of from 10 μm to 60 μm, the length may be from 5 mm to 40 mm.

The magnetic fiber may be used as received, but for example, may also be used as a fiber-shaped composite material coated with a material such as a resin or glass (that is, having a coating layer composed of a material such as a resin or glass). Examples of the resin include polyimides. The thickness of the coating layer may be, for example, from 2.5 μm to 10 μm, and may also be from 2.0 μm to 5.0 μm.

The method for forming the coating layer may be selected in accordance with the material of the coating layer, and examples include gas phase film-forming methods such as a sputtering method, a chemical vapor deposition (CVD) method, and a vacuum deposition method; and liquid phase film-forming methods such as coating using an immersion coating method, a roller coating method, a spray coating method and a sol-gel method.

The Curie temperature of the magnetic material may be, for example, in the case of fixing the image on the paper body by heat fixing, 200° C. or higher, or may also be 300° C. or higher.

Here, the term "Curie temperature" is also referred to as Curie point, and is a temperature at which when an amorphous material reaches this particular temperature, even after cooling, a change in the physical structure occurs in the amorphous state, so that the material loses its characteristics (for example, a large Barkhausen effect).

The magnetic fiber may be obtained by, for example, melting a magnetic material, passing the molten material through a discharge outlet having a shape that is corresponding to the cross-sectional shape of the magnetic fiber, and then cooling the fiber. Specifically, for example, an in-water rotary spinning method or the like is used. Furthermore, for example, after a magnetic material in the molten state is processed into a fiber form, and then a coating layer may be formed by a gas phase film-forming method such as CVD, for the purpose of cooling of the magnetic fiber as well.

Furthermore, for example, a magnetic fiber coated with a coating layer of glass or the like may also be produced according to the production method described in U.S. Pat. No. 3,256,584 (Taylor-Ulitovsky method). Specifically, for example, a metal alloy is charged into a glass tube, the front tip of the glass tube is melted by overheating with an induction coil to produce a state in which a molten metal material is coated around with molten glass, and the resultant is rapidly cooled with a coolant. Thereby, a magnetic fiber in which an amorphous magnetic wire is coated with glass, is obtained.

—Other Materials—

The paper body may include, if necessary, other materials in addition to the pulp fiber and the magnetic material.

Specific examples of the other materials include loading materials for regulating the opacity, white color and surface properties of the paper body.

Examples of the loading material include white inorganic pigments such as heavy calcium carbonate, light calcium carbonate, chalk, kaolin, calcined clay, talc, calcium sulfate, barium sulfate, titanium dioxide, zinc oxide, zinc sulfide, zinc carbonate, aluminum silicate, calcium silicate, magnesium silicate, synthetic silica, aluminum hydroxide, alumina, sericite, white carbon, saponite, calcium montmorillonite, sodium montmorillonite, and bentonite; and organic pigments such as acrylic plastic pigments, polyethylene, and urea resins. Furthermore, thermoplastic resin particles (for example, polyester-based or styrene-acrylic-based resin particles) and the like may also be used for loading. In the case of incorporating recovered paper, the fraction of the loading material contained in the recovered raw material may be estimated in advance, and the amount of addition of the loading material may be adjusted.

In the case of using an inorganic pigment as the loading material, the amount of incorporation of the inorganic pigment may be, for example, from 0% by weight to 10% by weight, and may also be from 0% by weight to 8% by weight. Furthermore, in the case of using an organic pigment, particularly thermoplastic resin particles as the loading material, the amount of incorporation of the organic pigment may be, for example, from 0% by weight to 10% by weight, and may also be from 0% by weight to 5% by weight.

As the other materials described above, for example, various chemicals such as a sizing agent may also be used in addition to the loading material. The various chemicals such as a sizing agent are added to the paper body by, for example, internal addition or external addition.

Examples of the type of the sizing agent include sizing agents such as a rosin-based sizing agent, a synthetic sizing agent, a petroleum resin-based sizing agent and a neutral sizing agent, and the sizing agent may also be used in combination with a fiber fixing agent such as sulfuric acid band or a cationized starch. Examples of the neutral sizing agent include an alkenyl succinic anhydride-based sizing agent, an alkyl ketene dimer, an alkenyl ketene dimer, neutral rosin, a petroleum size, an olefin-based resin, and a styrene-acrylic resin. Furthermore, examples of the surface sizing agent include oxidized modified starch, enzyme modified starch, polyvinyl alcohol, and cellulose modification products such as carboxymethyl cellulose, and these may be used singly or in combination.

As an example of the other materials, a cationic material which adjusts the surface of the paper body to be cationic, may also be used. In the case of using a cationic material, for example, the surface of the paper body may be treated with a hydrophilic cationic resin or the like.

As an example of the other materials, an inorganic material which regulates the electrical resistivity of the paper, such as sodium chloride, potassium chloride, calcium chloride, sodium sulfate, zinc oxide, titanium dioxide, tin oxide, aluminum oxide or magnesium oxide; or an organic material which regulates the electrical resistivity, such as an alkyl phosphoric acid ester acid, an alkyl sulfuric acid ester acid, sulfonic acid sodium salt, a quaternary ammonium salt, may be used singly or in mixture.

As another example of the other materials, a paper strengthening agent may also be used, and specifically, a paper strengthening agent may be added by internal addition or external addition. Examples of the paper strengthening agent include starch, modified starch, plant gums, carboxymethyl cellulose, polyvinyl alcohol, modified polyvinyl alcohol, polyacrylamide, a styrene-maleic anhydride copolymer, a vinyl chloride-vinyl acetate copolymer, a styrene-butadiene copolymer, a polyacrylic acid ester urea-formaldehyde resin, a melamine-formaldehyde resin, dialdehyde starch, polyethyleneimine, epoxidated polyamide, a polyamide-epichlorohydrin-based resin, methylolated polyamide, and chitosan derivatives, and these materials may be used singly or in mixture.

As the other materials, in addition to the materials described above, for example, various auxiliary agents that are incorporated into the paper base for conventional coated paper, such as a dye and a pH adjusting agent, may also be used as necessary.

—Paper Body—

The basis weight (JIS P-8124) of the paper body is not particularly defined, but may be, for example, in the range of from 50 g/m$^2$ to 105 g/m$^2$. Furthermore, the thickness of the paper body may be, for example, in the range of from 80 μm to 120 μm.

What is claimed is:

1. A paper comprising:

a paper body which contains pulp fiber, a magnetic material embedded in the interior of the paper body, the magnetic material having a large Barkhausen effect; and a pseudo-image which is formed on at least one surface of the paper body, the pseudo-image simulating an image of the magnetic material contained in the paper body;

wherein the pseudo-image includes a first image that is formed on the one surface of the paper body, and a second image that is formed on a surface opposite to the one surface of the paper body.

2. The paper of claim 1, wherein at least part of the first image and at least part of the second image overlap each other when projected in the thickness direction of the paper body.

3. The paper of claim 1, wherein the first image and the second image are directed in the same direction, and the first image and the second image are at positions at which two edges of the first image and two edges of the second image coincide when projected in the thickness direction of the paper body.

4. The paper of claim 1, wherein the pseudo-image includes an image which is simulative of the magnetic material contained in the paper body by a visual inspection by reflected light at the surface of the paper, and an image which is simulative of the magnetic material contained in the paper body by a visual inspection by light transmitted through the paper.

5. The paper of claim 1, wherein the magnetic material is localized in a central area with respect to a direction perpendicular to a papermaking direction, in a plane of the paper body.

* * * * *